United States Patent [19]

Wilkes

[11] Patent Number: 4,733,414

[45] Date of Patent: Mar. 29, 1988

[54] SPRING LOADED DRAIN CLEANING DEVICE

[76] Inventor: Karl A. Wilkes, 10345 Violetlawn, Detroit, Mich. 48204

[21] Appl. No.: 914,458

[22] Filed: Oct. 2, 1986

[51] Int. Cl.[4] ..... E03D 11/00

[52] U.S. Cl. ..... 4/255; 137/614.2

[58] Field of Search ..... 4/255–257; 137/614.2

[56] References Cited

U.S. PATENT DOCUMENTS

| | | | |
|---|---|---|---|
| 2,128,217 | 4/1938 | Anderson . | |
| 2,496,525 | 2/1950 | Eggleston | 4/255 |
| 2,697,842 | 12/1954 | Meyer . | |
| 3,641,597 | 2/1972 | David et al. . | |
| 3,934,280 | 1/1976 | Tancredi . | |
| 4,053,955 | 10/1977 | Canham | 4/255 |
| 4,097,937 | 7/1978 | Hofmann . | |
| 4,186,451 | 2/1980 | Ruo | 4/255 |
| 4,542,543 | 9/1985 | Irwin | 4/255 |

*Primary Examiner*—Henry J. Recla
*Assistant Examiner*—Linda J. Sholl
*Attorney, Agent, or Firm*—Peter D. Keefe

[57] ABSTRACT

A spring loaded drain cleaning device utilizing both positive and negative pressures to disrupt a clog. The invention is composed of a plastic hollow cylinder ending in an angled base cup having a gasket at its lower extremity, a cap at the top of the cylinder, a reciprocally mounted piston and a rod which permits the user to transmit forces onto the piston, and a biasing spring which acts on the piston. The user depresses the rod, causing the piston to descend down the cylinder resulting in fluidic compression in the drain above the clog, along with compression of the spring. Release of the rod results in a spring biased return of the piston up the cylinder, with an attendant negative fluidic pressure above the clog. The cycle is repeated in rapid succession until the clog clears.

3 Claims, 10 Drawing Figures

SPRING LOADED DRAIN CLEANING DEVICE

BACKGROUND OF THE INVENTION

This invention relates to drain cleaning devices, more particularly to piston-type plungers which operate on the principle of fluidic pressure.

Drains used in the plumbing arts employ an elbow section underneath the drain opening as a means to trap gases commonly found in sewer pipes from escaping into the environment. Often, these are the sites of clogs, where various forms of debris, such as hairs, lint, and other solids accummulate, blocking the drain.

Many attempts have been made in the past to devise an effective means to disrupt these drain clogs, permitting them to be washed away. A representative means in the piror art is U.S. Pat. No. 3,934,280 to Tancredi, which discloses a long, hollow cylinder enclosing a reciprocally movable piston, having at one end a handle attached to a piston rod and at the other a compressible membrane which acts as a drain gasket. In this invention, the user pushes down on the handle causing a compression of air in the drain, and, hopefully, movement of the clog.

However, there remains the long standing need in the art to be able to both compress and decompress the air above the clog in a quick, repetitious series of cycles. The reason is that the clog may actually suffer a density increase as a result of a singular compression and each subsequent compression will result in even greater compaction. This undesireable situation will cause the clog to become extremely tenacious and either harsh chemicals or a plumbing snake will be required to remove it. Prior solutions have not provided for the release of internally built-up pressure, and, hence, do not offer true functional suction action. The present invention is designed to render both a compression and decompression action, in a rapid succession, the resulting alternative between positive and negative pressure in the drain causing a disruption to the structure of the clog, assuring its speedy removal. This is accomplished by means of a by-pass slot in the lower interior wall of the cylinder which effects to automatically release the pressure built up as a result of the downward stroke, permitting a true suction action during the upward stroke.

Additionally, the prior art fails to disclose a functionally operable plunger which conveniently angles toward the user. Vertical operation is cumbersome due to the relatively long cylinders required to generate the sufficient stroke necessary to effectively influence the clog, and the fact that the faucet may protrude so far into the sink area that operation is precluded. U.S. Pat. No. 3,641,597 to David and Hebert discloses an angled base. However, this invention would tend to slide across the drain opening during the compression stroke, and the angle, being located at a point well above the drain, is such as to cause the gasket to lift away from the drain, destroying the compression, during the compression stroke. The present invention is designed to angle the plunger starting at the drain opening, eliminating this problem. Also, a lip is provided that fits into the drain opening which prevents sideward movement of the device during operation.

Lastly, the prior art discloses means to remove a clog utilizing only singular operative function; usually compressive action. The present invention affords two user selectable modes of operation: to (1) disrupt the clog, or (2) flush any remaining clog debris.

It is an object of the present invention, therefore, to provide a drain cleaning device which permits the user to readily and speedily deliver both positive and negative pressures to the clog, where the negative pressure is adduced automatically upon reversal of stroke movement.

It is a further object of the invention to provide a dual operational mode affording user selection of disrupting or flushing action.

It is yet a further object of the invention to provide a conveniently operating piston-type drain cleaner whereby the base is adapted to fit tightly over a drain opening and attendently angle the plunger in a direction several degrees off from the vertical, towards the user.

It is still a further object of the invention to provide a piston-type drain cleaner having a lip which fits into the drain, securing the device from slippage during the compression stroke.

These and additional objects, advantages, features and benefits of the invention will become apparent from the following specification.

SUMMARY OF THE INVENTION

In the present invention, a device is provided which enables the user to quickly, easily and effectively clean clogged drains. This is accomplished through the use of a specially adapted cylinder with integral reciprocating piston, the theory of operation of which is to rapidly deliver to the drain opening positive and negative pressures that effect to disrupt the clog, allowing it to be washed away.

The invention consists externally of a long, hollow cylinder, having at one end a flaired cup, ending in a compressible gasket, adapted for fitting over a conventional drain opening. A lip is provided in the cup to ensure, via cooperative engagement with the drain opening, continuous proper alignment over the drain during operation. Additionally, a one-way valve is provided in the cup, the purpose of which is to assist the reciprocal action of an internal piston. At the other end, is a cap having an aperture permitting the extension of a rod therethrough, having at its end a handle. Internally, a reciprocally mounted piston is located in the axial hollow region inside the cylinder, the upper end of the piston connecting with the rod. At the lower end of the cylinder, is located a slot in its interior wall of length greater than the width of the piston which serves to automatically release pressure built up in the drain during the compression stroke; the one-way valve is provided with an exterior control valve which allows compression during the down stroke and suction during the up stroke. A spring is located inside the cylinder as well, extending from the cup location to the lower end of the piston. The normal, untensioned length of the spring extends a distance beyond the total stroke of the piston inside the cylinder; thus, the piston is under continuous biasing away from the cup, even when it is at the uppermost location in the cylinder.

In operation, the user simply positions the invention over the clogged drain, then places the cupped end down, being careful to note that the lip has seated just inside the drain opening. A quick push downward on the piston rod produces high pressure in the drain, pushing on the clog. When the piston has reached its lowest point, it encounters a pressure by-pass slot in the cylinder wall, releasing the built-up pressure in the drain.

The user now has a choice, during the up stroke of whether to disprupt the clog by suction action or allow water to enter the cup through the one-way valve for purposes of flushing any remaining debris during the next down stroke; manual turn of the control valve secures the desired function. Pulling upward on the piston rod, aided by the spring, returns the piston to the upper end of the cylinder. Repeated pushing down on, and relase of, the piston rod causes a rapid succession of pressure differentials acting on the clog, resulting in its disruption and removal.

DETAILED DESCRIPTION OF THE PREFERRED EMBODIMENT

Figure 1:
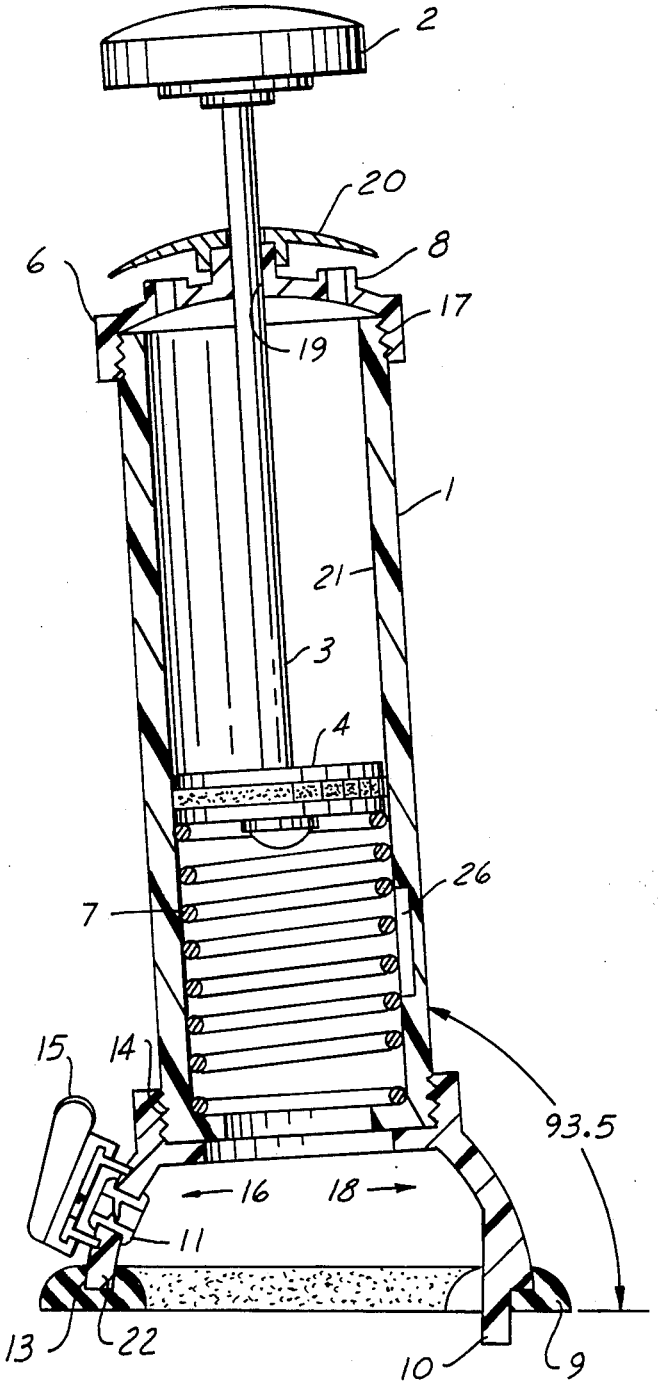
FIG. 1 is a sectional side view of the invention.

Referring now to the figures, FIG. 1 shows generally the invention in cross section, disposed to the near vertical, as it would be in operation. A long, axially hollow cylinder 1 of cross sectional diameter on the order of a drain opening, is constructed of a high strength non-corrosive material, such as plastic. At the lower of the cylinder is a cup 5, made of rigid, non-corrosive materials, again for example, plastic. The cup is attached to the lower portion of the cylinder through the use of threads 14, the purpose of which is to permit easy disassembly of the device. The cup is circular in shape at its lower edge, but it is not uniformly the same length from the cylinder. Side 16 is shorter than side 18, forming an angled base for the cylinder when the cup rests on a flat surface, at an angle between 92 and 97 degrees, preferably 93.5 degrees, with the horizontal. It is, however, possible to operate the invention successfully where the angle is 90 degrees. At the lower edge of the cup is attached a gasket 9 which is made out of a compressible readily sealing material, such as soft rubber. The gasket is preferably attached to the cup by means of a compression fitting, where the gasket is slotted 13 to conform tightly to the lower thickness 22 of the cup, as shown in the Figure; or it may be glued into place. The cup 5 has a lip 10 which extends below the gasket on that side 18 of the cup which is of greatest length from the cylinder. The purpose of this lip is to extend down into the drain opening and serve as an anchor to prevent slippage of the gasket during a downward, or compression, stroke.

At the top of the cylinder is cap 6 which is designed to cooperatively screw onto threads 17 in the cylinder. An aperture 19 in the center of the cap is provided which allows a rod 3 to pass through. The rod terminates above the cap in a handle 2. An air pressure relief vent 8 is provided in the cap. Above the cap is a splash guard 20, made of a flexible material, which is designed to prevent any liquids that may exit through the air pressure relief vent from making contact with the user.

Inside the cylinder, a piston 4 is provided which tightly seals with the adjacent interior cylinder walls 21, which is intended to move reciprocally therein. The upper end of the piston connects to the rod 3, by specific means to be elaborated shortly. A spring 7 is located between the lower end of the piston 4 and the lower end of the cylinder, where a circular lip 23 is provided to retain the spring in the cylinder. The spring and its spring constant are chosen to provide a compressive action even when the piston is fully up the cylinder, adjacent to the cap; however, such compressive action must not be so great, when the piston is fully down the cylinder, adjacent to the circular lip, so as to require an undue amount of force by the user, where the user is contemplated as anyone, inclusive of young adults.

Figure 2:
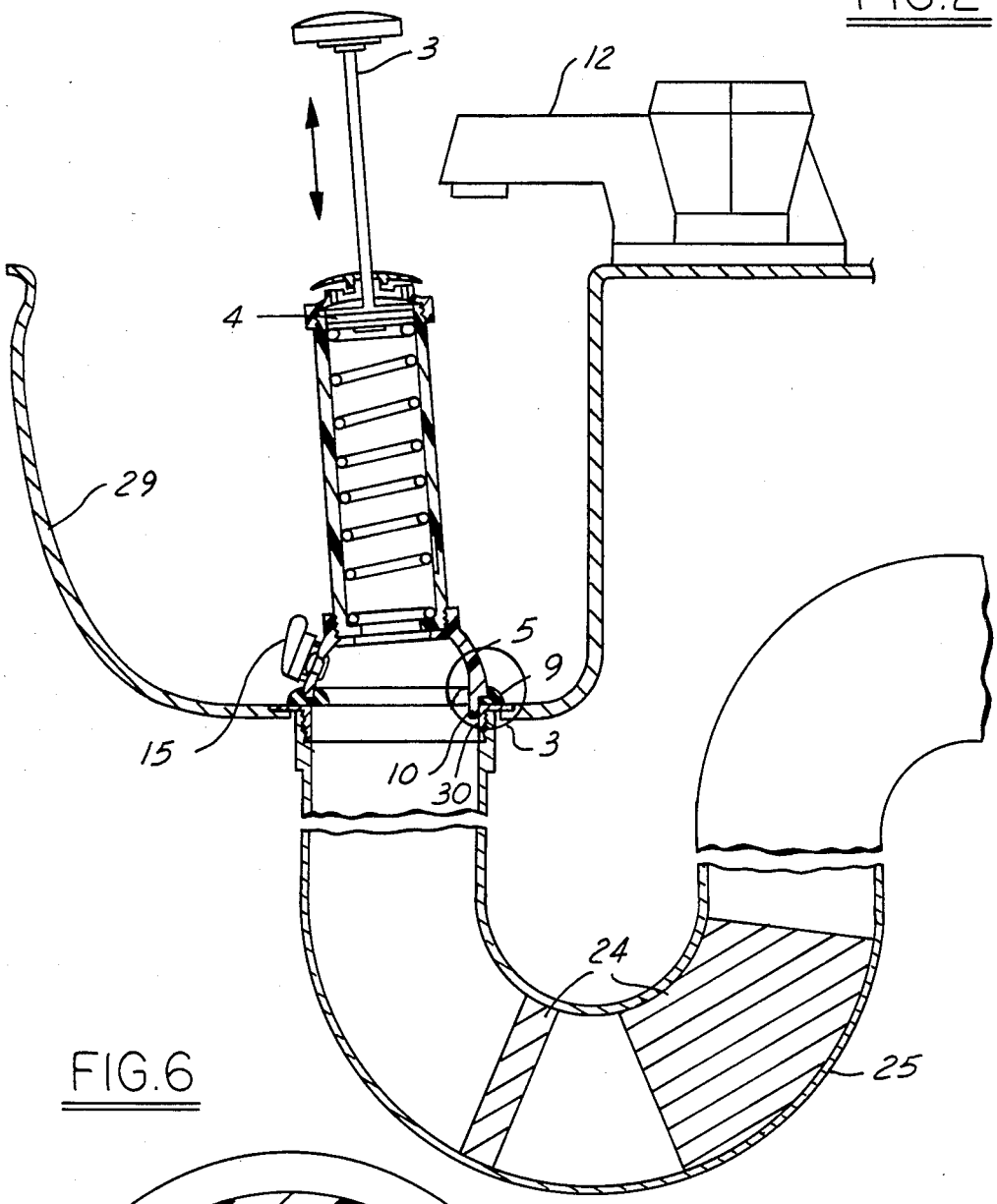
FIG. 2 is a sectional side view of the invention in operation.

FIG. 2 shows the invention in operation disposed above a sink drain. Notice that the angular design of the cup causes the cylinder to tilt away from an otherwise obstructing faucet 12. The piston is shown in the fully raised position in preparation for application of a compression stroke by the user. The gasket is seated flat against the sink surface 29 and the lip is seated against the wall 30 in the drain opening in the direction of the faucet. The clog 24 may be seen located in the elbow 25 of the drain pipe.

Figure 3:
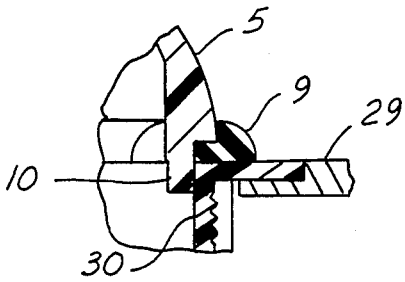
FIG. 3 is a detail sectional side view of the anti-sliding feature of the invention.

FIG. 3 shows in detail how the lip cooperatively engages the drain wall as well as the manner in which the lip pentrates locally through the gasket.

Figure 4:
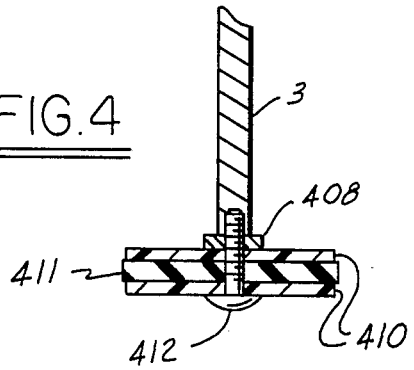
FIG. 4 is a sectional side view of the piston assembly, according to the preferred embodiment of the invention.

FIG. 4 disclosed the construction of the piston. A sandwich is formed by the interposition of two hard washers 410 outside a soft washer 411. The composition of the hard washers is of a non-corrosive material, such as plastic; the composition of the soft washer, which acts as a piston ring, is a durable, sealable material, such as rubber. The sandwich arrangement is attained by use of an aperture drilled through the center of the washers which permits a bolt 412 to be inserted therethrough, which is in turn screwed into a threaded aperture 413 in the lower end of the rod 3. The Figure also discloses a smaller hard washer which positions between the rod and the piston sandwich.

Figure 5:
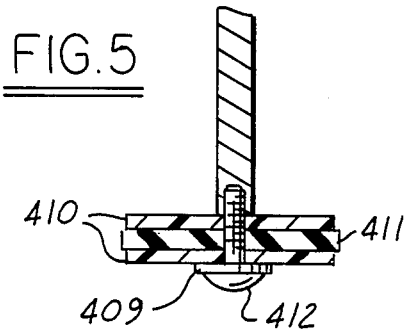
FIG. 5 is a sectional side view of the piston in FIG. 4, showing an alternate design.

FIG. 5 discloses the same piston assembly disclosed in FIG. 4, but now the small washer 408 is eliminated and a small, soft, sealing washer 409 is utilized between the head of the bolt 412 and the piston sandwich.

Figure 6:
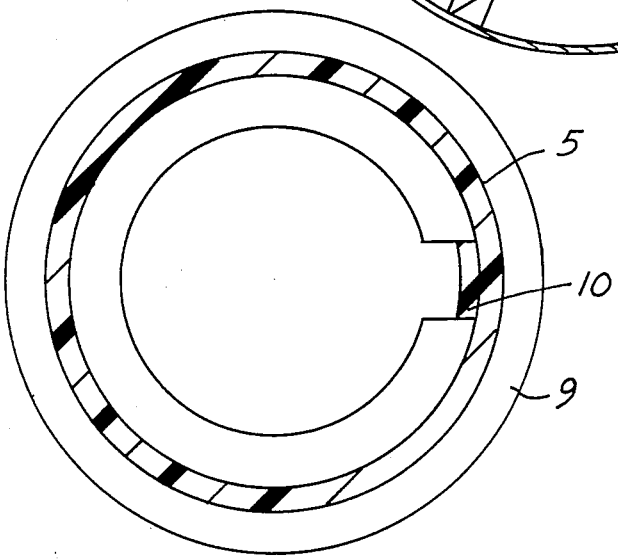
FIG. 6 is an axial view of the invention showing in cross section the components at the lower end of the cylinder.

FIG. 6 shows axially where the lip 10 is located on the cup 5. Note that the circumferential extent of the lip is relatively very small, on the order of one-half inch.

Figure 7:
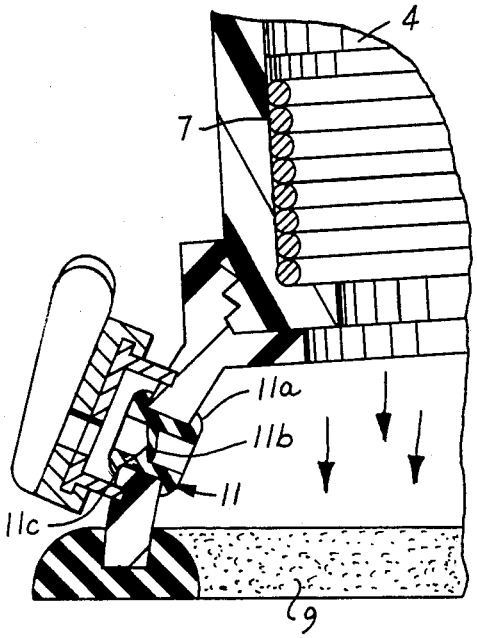
FIG. 7 is a sectional side view of the invention showing operation of the one-way valve during a compression stroke.

FIG. 7 shows a conventional one-way valve 11 located on the side 16 of the cup 5. The purpose of the valve is to allow air or water entry into the cylinder between the piston and the clog during the upward, or suction, stroke. This is necessitated in situations where the clog is semi-porous, allowing the compressed air produced during a compression stroke to leak out, but is, also, sufficiently non-porous that the suction stroke is impeded by too slow a delivery rate of an air intake through the clog material. The Figure shows the valve closed during a compression stroke. The exact construction of the valve may be seen by reference to the Figure, as follows. The valve, which may be any commercially available one-way type having adaptability to the invention, consists of an essentially circular, hollow disk 11*a* which is attached to an aperture in the cup wall by gluing or threading. Inside the disk is a hard, pliable non-porous membrane 11*b* of circular shape. The membrane is attached to the inside of the disk at one point in its circumference. A washer 11*c* having an inside diameter less than the hollow disk is located adjacent to the non-porous membrane on the side closest to the cup exterior. Because of adjacency, a positive pressure inside the cup acts to seal the membrane against the lip formed by the differential between inside diameters of the washer and hollow disk. However, when a negative pressure exists inside the cup, the membrane swings away from the lip, and admits entry of air or water into the cup.

Figure 8:
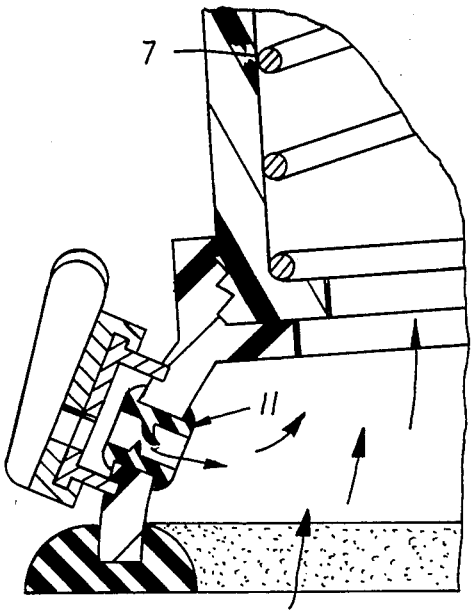
FIG. 8 is a sectional side view as in FIG. 7 during a suction stroke.

FIG. 8 shows the same one-way valve now open and admitting air or water to flow into the cylinder during a suction stroke.

Figure 9:
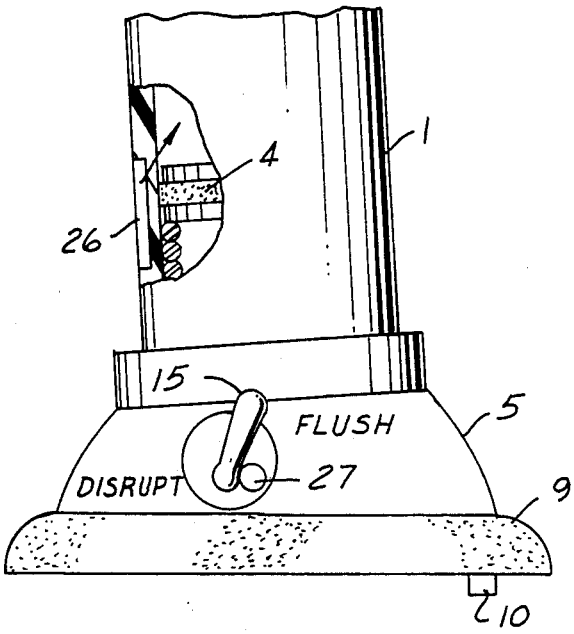
FIG. 9 is a sectional side view of the invention showing the location of the control valve.
Figure 10:
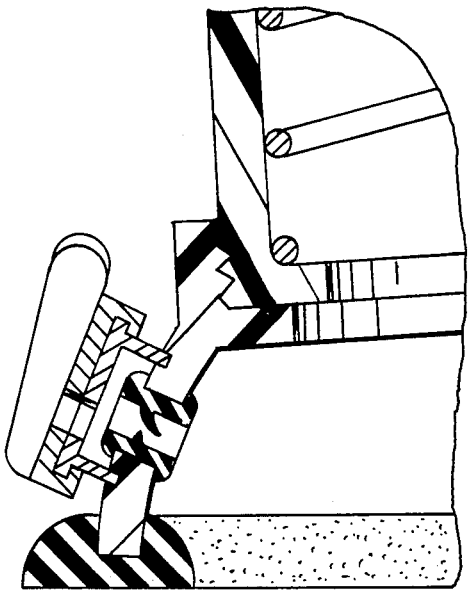
FIG. 10 is a detail sectional view of the control valve shown cooperating with the one-way valve.

A preferred alternative embodiment for the invention provides for the automatic release of internal pressure when the piston has reached its lowest point during the down stroke as well as alternative modes of operation, shown in FIGS. 9 and 10. One or more by-pass slots 26 are provided on the interior wall 21 of the cylinder each having a length which exceeds the thickness of the piston, and each located at the point of lowest extent of the piston within the cylinder. Air that is compressed by downward motion of the piston within the cylinder is automatically released when the piston reaches the by-pass slot, since air may now circulate around the piston to the upper end of the cylinder, ultimately being release to the atmosphere through the air vent in the cap.

A manually operated control valve 15 is provided on the cup immediately between the exterior surface of the cup and the one-way valve. Its function is to alternatively cover or uncover an opening which permits fluid communication between the exterior of the cup and the one-way valve. The control valve consists of a covering, which may be in the form of a handle, which is pivotably attached to the cup, and which may be rotated to alternative positions which may cover or uncover an opening 27 in a housing 28 which covers the cup in the vicinity of the one-way valve, as particularly shown in FIG. 10. The control valve serves to allow the user to determine whether the one-way valve functions during operation. By disallowing its functioning, fluids, such as basin water, which are exterior to the cup may be excluded from entry into the interior of the cup. This would be utilized in situations where disruption of the clog by alternative compressive and decompressive stroking are engaged. By allowing its functioning, typically basin water is allowed to flow into the cup which can then be utilized to deliver an improved force against the clog, since liquids are incompressible, or to flush loose debris down the drain in a more effective manner than might be afforded by compressed air alone.

In operation, the user after extending the handle maximally outward, positions the invention over the clogged drain opening, and lowers the gasket end over the drain, making sure that the lip in the cup seats against the drain wall most nearly facing the faucet, that is, that part of the drain wall which is directly away from the user. Ordinarily, the control valve would be turned to closed or "suction". Then grabbing the handle on the rod, the user pushes down, resulting in a "compression stroke", forcing the piston downward compressing the air in the drain. The air vent in the cap permits the air in the upper end of the cylinder to remain at atmospheric pressure as the piston descends down the cylinder. At the lowest point in the stroke, the by-pass slot will allow the compressed air to escape via the air vent in the cap. This may alone be sufficient to clear the clog.

If the clog remains the user releases the handle and pulls upward on the handle, with the spring assisting, until the piston has returned to its uppermost location in the cylinder. In this case, the air vent serves to release air inside the upper end of the cylinder as the piston ascends up the cylinder, retaining atmospheric pressure. During this process, a suction action is developed between the lower end of the piston and the clog, causing the particles of the clog to be pulled oppositely to the direction urged during the compression stroke. The compression stroke followed immediately by the suction stroke over several repetitions should ordinarily be sufficient to dislodge even the most tenacious of clogs.

If desired, the user may partially fill the sink with water and utilize the incompressibility of this fluid to assist during the compression stroke. This is accomplished by turning the control valve to open or "flush", uncovering the opening to the one-way valve. Now, during the suction, or up, stroke, basin water may enter into the cup space between the lower end of the piston and the clog. By next supplying a compression, or down, stroke, the incompressibility of the water will aid the user in forcing the clog down the drain. Also, this may be utilized to provide a flushing action to ensure complete removal of all drain debris.

It should be noted that many conventional drains have anti-overflow provisions in the form of apertures in the sink just below the uppermost point on the bowl. Consequently, in order for the compression and suction strokes to achieve a maximum affect on the clog, the overflow aperture in the sink structure must be plugged by clay, rubber, or some other convenient plugging material.

To those skilled in the art to which this invention apertains, the above described preferred embodiment may be subject to change or modification. Such changes or modifications can be carried out without departing from the scope of the invention, which is intended to be limited only by the scope of the appended claims.

What is claimed is:

1. A spring loaded drain cleaning device, comprising:

a hollow cylinder having at least one by-pass slot on its inside surface;

a cap removably attached to a first end of said cylinder, said cap further having a centrally positioned aperture and an air vent, said cap further having a splash guard attached thereto so as to prevent liquids exiting from said air vent from making contact with a user of said spring loaded drain cleaning device;

a cup removably attached to a second end of said cylinder, said cup having sides of circumferentially varying lengths, and sides of varying lengths terminating in a gasket, said sides of varying lengths providing said cylinder with an angle within a range substantially between 90 and 97 degrees as measured between the axial center of said hollow cylinder and a drain surface over which said hollow cylinder is placed;

a one-way valve attached to said cup which permits fluid passage when negative pressure exists in said cylinder;

a control valve attached to said cup for turning on and off functioning of said one-way valve;

a piston sealingly mounted inside said cylinder for reciprocation therein, said piston having a thickness in length less than said by-pass slot, said piston further having an end of downward stroke at the axial position on said cylinder where said by-pass slot is located;

a rod attached to said piston at its upper end and extending through said aperture in said cap, said rod terminating in a handle; and a biasing spring inside said cylinder located between said cup and said piston so as to provide biasing action between said cylinder and said piston.

2. A spring loaded drain cleaning device, comprising:

a hollow cylinder having at one end a cap with a centrally positioned aperture and an air vent, said hollow cylinder further having at the other end a cup which terminates in a gasket;

a piston sealingly mounted inside said cylinder for reciprocation therein;

a rod attached to said piston at its upper end, said rod extending through said aperture in said cap, said rod further terminating in a handle;

a biasing spring inside said cylinder located between said cup and said piston at its lower end to provide biasing action between said cylinder and said piston; and a one-way valve located on said cup, said one-way valve permitting fluid passage only when a negative pressure exists in said cup, said one-way valve further being provided with a control valve for turning on and off functioning of said one-way valve.

3. A spring loaded drain cleaning device, comprising:

a hollow cylinder having at one end a cap with a centrally positioned aperture and an air vent, said hollow cylinder further having at the other end a cup which terminates in a gasket, said cylinder further having at least one by-pass slot located on the inside surface of said cylinder;

a piston sealingly mounted inside said cylinder for reciprocation therein, said piston having a thickness in length less than said by-pass slot, said piston further having an end of downward stroke at the axial position on said cylinder where said by-pass slot is located;

a rod attached to said piston at its upper end, said rod extending through said aperture in said cap, said rod further terminating in a handle;

a biasing spring inside said cylinder located between said cup and said piston at its lower end to provide biasing action between said cylinder and said piston; and a one-way valve located on said cup, said one-way valve permitting fluid passage only when a negative pressure exists in said cup.

* * * * *